United States Patent [19]

Torres

[11] 4,081,288

[45] Mar. 28, 1978

[54] SUGAR CLARIFYING COMPOSITION

[75] Inventor: Julio C. Torres, Cali, Colombia

[73] Assignee: Fabcon International, Inc., San Francisco, Calif.

[21] Appl. No.: 749,844

[22] Filed: Dec. 13, 1976

[51] Int. Cl.[2] ..... C13D 3/00; C13D 3/02; C13F 1/02

[52] U.S. Cl. ..... 127/48; 127/50; 127/61

[58] Field of Search ..... 127/48, 50, 61, 60, 127/62

[56] References Cited

U.S. PATENT DOCUMENTS

| | | | |
|---|---|---|---|
| 2,249,920 | 7/1941 | Taussig et al. | 127/50 |
| 3,926,662 | 12/1975 | Rundell et al. | 127/50 X |

FOREIGN PATENT DOCUMENTS

| | | | |
|---|---|---|---|
| 2,276,857 | 1/1976 | France | 127/48 |

OTHER PUBLICATIONS

G. L. Spencer et al., Cane Sugar Handbook, pp. 798–800, 8th Ed. (1945).

*Primary Examiner*—Joseph Scovronek
*Attorney, Agent, or Firm*—Townsend and Townsend

[57] ABSTRACT

An improved process in the production of sugar is provided by adding to a sugar solution prior to crystallization calcium acid phosphate, followed by the addition of soda ash. Optionally, in a third step sodium hydrosulfite is added. The resulting sugar is of a high grade, being light colored and substantially free of impurities.

12 Claims, No Drawings

SUGAR CLARIFYING COMPOSITION

BACKGROUND OF THE INVENTION

1. Field of the Invention

In a typical sugar mill, the juice is first extracted from the cane, lime is added to raise the pH to above 7, the juice is heated, and then goes to a clarifier in which the precipitates formed by the action of heat and lime are eliminated to as great a degree as possible. The clarified juice then travels to a series of evaporators or a multiple effect evaporator where the juice is concentrated from an entering concentration of about 15 or 16% of sugar to a syrup having a concentration of about 65% sugar. The syrup from the evaporators then proceeds to vacuum pans where further evaporation is accomplished by boiling the syrup under reduced pressure. The syrup is evaporated in the vacuum pans until it becomes a saturated or supersaturated solution of sugar. The syrup is then seeded to initiate crystal growth and when an evaporation pan has become filled with a fairly dense mixture of crystals and syrup known as "massecuite" the contents of the pan, called a "strike" is discharged. The strike is normally cooled with slow mixing in a crystallizer to permit additional extraction of sugar from molasses to crystals as the mass cools. The mass is then centrifuged to separate the sugar crystals from the molasses.

In most sugar factories, the "three boiling" system is empolyed. The first boiling of pure syrup yields what is known as A sugar and A molasses. The A molasses with a "footing" of sugar crystals and some syrup is reboiled to provide a second massecuite which in turn provides what is called a B strike that provides B sugar and B molasses. The operation is again repeated with the B molasses in a footing of sugar crystals and syrup. The strike is called a C strike and the crystallization operation then produces C sugar and C molasses, which is the final "black strap" molasses.

The efficiency of the system is determined by minimizing the amount of the final molasses produced for a given amount of sugar juice, as well as having a minimum sucrose concentration in the black strap molasses. Ordinarily, the A and B sugars are sold, while the C sugar is used for seeding and recirculation in liquid form to the A and/or B pan.

The industry is continuously looking for improvements in providing efficient and economic ways to produce sugar, by speeding up crystallization, by enhancing the A and B sugar yields, and by reducing the impurities in the sugar.

2. Description of the Prior Art

U.S. Pat. No. 3,401,059 teaches the use of sodium sulfosuccinate to enhance the efficiency of sugar crystallization.

SUMMARY OF THE INVENTION

In accordance with the subject invention, a sugar solution (cane juice or cane syrup) is treated simultaneously or sequentially with a calcium phosphate salt and soda ash. Optionally, a minor amount of sodium hydrosulfite may be added in subsequent processing. An enhanced yield of high purity sugar is obtained with rapid crystallization, providing for more efficient use of equipment.

DESCRIPTION OF SPECIFIC EMBODIMENTS

An improved process for the purification of sugar is provided, whereby a small but sufficient amount of calcium acid phosphate and soda ash are added either simultaneously or sequentially to cane juice or cane syrup. Preferably, the additions of these materials accompanied by other additives. Advantageously, sodium hydrosulfite is added in minor amounts to the crystallizing pans.

The calcium acid phosphate may be added by itself or preferably in combination with other materials. The following Table 1 indicates the calcium acid composition, the broad range and the preferred range for each of the components.

Table 1

| | Broad Range wt % | Preferred Range wt % |
|---|---|---|
| $CaHPO_4 . 2H_2O$ | 10–100 | 40–100 |
| $Al_2(SO_4)_3$ | 0–40 | 0–20 |
| Kaolin | 0–40 | 0–20 |
| $Na_3PO_4 . H_2O$ | 0–90 | 0–30 |
| Na polyacrylamide* | 0–5 | 0–2 |

*The polyacrylamide is anionic providing a pH at about 0.5 weight percent in $H_2O$ of about 9.5 to 10.5 at 20° C and has a weight average molecular weight in excess of 500,000 and less than about $20 \times 10^6$. An illustrative composition is Separan AP273, supplied by Dow Chemical Co.

The polyacrylamide aids in the settling of solids from the sugar solutions.

It is understood that the waters of hydration are indicated because the commerically available materials are employed. Evidently, the waters of hydration do not play a role in the subject invention and the anhydrous material or salts having different degrees of hydration could be employed.

The phosphate composition will normally be added to provide a concentration of about 10–500ppm, more usually from about 15–40ppm.

The soda ash composition will have a composition as described in Table 2, with both the broad range and preferred range being indicated.

Table 2

| | Broad Range wt % | Preferred Range wt % |
|---|---|---|
| $Na_2CO_3$ | 10–100 | 40–70 |
| NaOH | 0–80 | 0–50 |
| CaO | 0–80 | 20–50 |
| MgO | 0–40 | 0–20 |

The soda ash composition will normally be added in an amount to provide a concentration of about 2 to 200ppm, more usually from about 5 to 20ppm. Desirably, the soda ash addition should provide a pH in the sugar medium of from about 6 to 8, preferably about 7.

Only very small amounts of sodium hydrosulfite will be employed. Normally, the amount added should be sufficient to provide a concentration of from about 1 to 5ppm.

As indicated previously, the calcium acid phosphate and soda ash compositions may be added simultaneously and/or sequentially. In order to prevent reaction between the two components, so as to change the nature of the individual chemicals, it is necessary when adding the additives simultaneously, to either meter them as a dry powder, or, alternatively, rapidly slurry the two compositions together and immediately add them to the sugar medium to be treated. Either method is effective, but in some instances, one method may have significant advantages over the other one.

A general description of the process for the manufacture of sugar from sugar cane has already been indicated. In employing the subject additives, the first stage where the additives may be added is in conjunction with the liming process. After the cane juice has been limed, the limed cane juice is heated and then passed to a clarifier, where the concentration of sugar is at least about 15 weight percent, and generally less than about 25 weight percent, more usually about 20 weight percent. Prior to introduction in the clarifier, the aforementioned additives may be introduced into the limed juice stream.

The addition of these additives at this point in the processing provides a number of advantages. It provides for enhanced settling of impurities from the juice, so as to produce a pure product in the subsequent processing steps.

The sugar juice is concentrated by evaporation generally to a concentration of at least about 60 weight percent to form sugar syrup. The sugar syrup is then transferred to treating pans which may be sectioned, so as to provide successive cells with the syrup overflowing from one cell to the next. Conveniently, air is employed to agitate the syrup in the cells. Again, the compositions of this invention may be added simultaneously or sequentially. While the process can be carried out batch wise, normally the process is continuous, so that the additives are metered into the sugar medium continuously.

In this process, the sugar syrup is divided into three parts: A sugar foam; a residue, and a purified syrup. The foam is removed and the syrup transferred to the crystallizing pans, where the sodium hydrosulfite may now be added.

In a large scale run in a sugar processing plant, 168 tons of cane juice was treated. The cane juice, which had not been previously treated with sulfur nor sodium hydrosulfite, was introduced into the first compartment of the clarifier and the calcium phosphate composition added when the first compartment of the clarifier began to fill with air bubbled into the juice for agitation. When the second compartment of the clarifier was beginning to fill, the soda ash composition was added and the air valves opened for agitation. When the second compartment began to overflow into the third compartment, the air was introduced for agitation of the syrup in the third compartment.

When the treating was finished, the syrup free of the foam and residue was introduced into the crystallizing pan and a smooth uniform evaporation showing a rapid growth of crystals was achieved. A small amount of sodium hydrosulfite was added, far smaller than normally employed. The normal boiling time in the A pan in this factory is 2.5 hours with a load of 550 cubic feet of molasses C. With the subject process, this time is reduced to 2 hours with a purity in the first molasses of 78. The following table is a comparison of the properties of the product by the normal process in the factory, employing sulfur and hydrosulfite, and the process described above.

Table 3

| | Sulphitating | Subject Process |
|---|---|---|
| juice pH | 3.8–4.0 | 5.8–6.0 |
| clear juice pH | 5.7–6.0 | 6.8–7.0 |
| syrup pH | 5.8–6.0 | 6.8–7.0 |
| Clear juice brix | 15.0–15.5 | 15.5–16.0 |

Table 3-continued

| | Sulphitating | Subject Process |
|---|---|---|
| Syrup brix | 54.0–55.0 | 56.0–57.0 |
| 'A' M.C.* $ft^3$/ton cane | 3.48 | 3.61 |

*M.C. = massecuite

It is evident from the above results, that a better yield of a purer product is obtained by the subject process, than by the prior art process. Furthermore, the process is more efficient, in that shorter crystallizing times are required, greatly enhancing the plant capacity. Not only is a better product and a more efficient process provided, but numerous disadvantages associated with the use of sulfur are avoided. When sulfur is employed, the sugar product frequently darkens after three to six months to a lower grade and occasionally an unsalable product. The presence of the sulfur leads to hard incrustations in heaters and evaporators. Thus by employing the subject process, the disadvantages associated with the use of sulfur are avoided.

Although the foregoing invention has been described in some detail by way of illustration and example for purposes of clarity of understanding, it will be obvious that certain changes and modifications may be practiced within the scope of the appended claims.

What is claimed is:

1. In a process for the preparation of purified cane sugar including the steps of:

(1) liming by adding lime to cane sugar juice to raise the pH to above about 7;
(2) heating the cane sugar juice;
(3) separating precipitates in a clarifier to provide a clarified cane sugar juice;
(4) evaporating said cane sugar juice in one or more evaporators to obtain a concentrated syrup;
(5) agitating said concentrated syrup from the resulting foam and residue;
(6) further evaporating said purified concentrated syrup in vacuum pans to obtain at least a saturated syrup; and
(7) crystallizing sugar from said saturated syrup in crystallizing pans to obtain massecuite;

the improvement which comprises:

adding to a cane sugar solution prior to crystallization of said sugar, a composition (A) and a composition (B), wherein:

A is comprised of

| Ingredient | Weight Percent |
|---|---|
| $CaHPO_4 . 2H_2O$ | 10–100 |
| $Al_{(11)2}(SO_4)_3$ | 0–40 |
| Kaolin | 0–40 |
| $Na_3PO_4 . H_2O$ | 0–90 |
| Na polyacrylamide | 0–5 |

and B is comprised of

| Ingredient | Weight Percent |
|---|---|
| $Na_2CO_3$ | 10–100 |
| NaOH | 0–80 |
| CaO | 0–80 |
| MgO | 0–40 |

wherein composition (A) is added in an amount to provide 1–500ppm and composition (B) is added in an amount to provide 2–200ppm;

and obtaining a highly purified cane sugar.

2. A process according to claim 1, wherein compositions A and B are slurried together and added immediately to said sugar solution.

3. A process according to claim 2, wherein composition A and B are added to cane sugar solution having at least about 15 weight percent sugar and after liming but before introduction into the clarifier.

4. A process according to claim 2 wherein said sugar solution has at least about 60 weight percent sugar and compositions A and B are added to said treating pans agitated with air.

5. A process according to claim 1, wherein compositions A and B are added sequentially as dry powders.

6. A process according to claim 5, wherein compition A and B are added to cane sugar solution having at least about 15 weight percent sugar and after liming but before introduction into the clarifier.

7. A process according to claim 5 wherein said sugar solution has at least 60 weight percent sugar and compositions A and B are added to said treating pans agitated with air.

8. A process according to claim 1, wherein one to five ppm of sodium hydrosulfite is added to said crystallizing pans.

9. A process according to claim 1, wherein the composition of A is:

| Ingredient | Weight Percent |
|---|---|
| $CaHPO_4 \cdot 2H_2O$ | 40–100 |
| $Al_2(SO_4)_3$ | 0–20 |
| Kaolin | 0–20 |
| $Na_3PO_4 \cdot H_2O$ | 0–30 |
| Na polyacrylamide | 0–2 |

and the composition of B is

| Ingredient | Weight Percent |
|---|---|
| $Na_2CO_3$ | 40–70 |
| NaOH | 0–50 |
| CaO | 20–50 |
| MgO | 0–20 |

10. A process according to claim 9, wherein said sugar solution has at least about 60 weight percent sugar and compositions A and B are added to said treating pans.

11. A process according to claim 10, where composition A is added in an amount of from about 15–40 ppm and composition B is added in an amount of from about 5–20 ppm.

12. A process according to claim 11, wherein sodium hydrosulfite is added to said crystallizing pans in an amount of from about 1 to 5 ppm.

* * * * *